United States Patent [19]

Sonntagbauer

[11] Patent Number: 5,006,784

[45] Date of Patent: Apr. 9, 1991

[54] THYRISTOR ON-LOAD CHANGE-OVER SWITCH

[75] Inventor: Ernst Sonntagbauer, Vienna, Austria

[73] Assignee: Elin-Union, Vienna, Austria

[21] Appl. No.: 458,735

[22] PCT Filed: Jun. 14, 1988

[86] PCT No.: PCT/AT88/00045

§ 371 Date: Dec. 6, 1989

§ 102(e) Date: Dec. 6, 1989

[87] PCT Pub. No.: WO88/10502

PCT Pub. Date: Dec. 29, 1988

[30] Foreign Application Priority Data

Jun. 25, 1987 [AT] Austria ..... 1601/87

[51] Int. Cl.[5] ..... H01F 29/04

[52] U.S. Cl. ..... 323/343; 361/9; 361/13

[58] Field of Search ..... 323/257, 258, 340–343; 307/137; 361/9, 13

[56] References Cited

U.S. PATENT DOCUMENTS

| | | | |
|---|---|---|---|
| 3,651,375 | 3/1972 | Ebersohl . | |
| 3,662,253 | 5/1972 | Yamamoto . | |
| 3,786,337 | 1/1974 | Kugler . | |
| 4,081,741 | 3/1978 | Palmer . | |
| 4,301,489 | 11/1981 | Stich | 361/9 |
| 4,363,060 | 12/1982 | Stich | 361/8 |
| 4,550,285 | 10/1985 | Kugler et al. | 307/137 |
| 4,571,499 | 2/1986 | Wein | 323/343 |
| 4,622,513 | 11/1986 | Stich | 323/343 |

FOREIGN PATENT DOCUMENTS

| | | | |
|---|---|---|---|
| 1935954 | 1/1970 | Fed. Rep. of Germany | 323/343 |
| 2125471 | 12/1972 | Fed. Rep. of Germany . | |
| 1275588 | 5/1972 | United Kingdom | 323/343 |
| 1399528 | 7/1975 | United Kingdom . | |
| 1007496 | 10/1965 | United Kingdom . | |
| 2104076 | 3/1976 | Fed. Rep. of Germany . | |
| 2327610 | 5/1978 | Fed. Rep. of Germany . | |
| 0124904 | 11/1984 | European Pat. Off. . | |
| 0116748 | 8/1984 | European Pat. Off. . | |

*Primary Examiner*—William H. Beha, Jr.
*Attorney, Agent, or Firm*—Sandler, Greenblum & Bernstein

[57] ABSTRACT

The invention relates to an arrangement in an on-load change-over switch of an on-load tap changer for uninterrupted switch-over of the regulating winding of a transformer. On-load change-over switching is usually accomplished using mechanical switching elements. Burning of contact and contamination of oil are disadvantageous. Furthermore, there are known constructions which use a combination of mechanical switching elements and thyristors for on-load change-over switching. The disadvantage of such arrangements is mainly the too great constructional expenditure for the control elements which are liable to breakdown. According to the invention, the on-load current is supplied to a common output line via a lower winding tap or a higher winding tap of a regulating stage of a regulating winding, and through at least two selector contacts and two permanent contacts whereby the switch-over from the lower to the higher winding tap, and vice versa, is effected via a change-over switch which briefly switches the on-load current to a load relief circuit which is arranged between the root connection of the change-over switch and the common output line. The discharge circuit could comprise, for example, two thyristor circuits, the thyristors of which are connected in antiparallel, one of these thyristor circuits being connected in series with a transition resistor.

2 Claims, 5 Drawing Sheets

THYRISTOR ON-LOAD CHANGE-OVER SWITCH

BACKGROUND OF THE INVENTION

The present invention relates to a new and improved arrangement in an on-load change-over switch of an on-load tap changer for uninterrupted switch-over of the regulating winding of a transformer.

In its more particular aspects, the present invention specifically relates to a new and improved arrangement in an on-load change-over switch of an on-load tap changer for uninterrupted switch-over of the regulating winding of a transformer and wherein the on-load current can be conducted via a lower or higher winding tap of a regulation stage of a regulating winding and through a connection of at least two selector contacts and two permanent contacts with a common output line. Furthermore, the switch-over from the lower to the higher winding tap or vice versa is effected via a first change-over switch in a manner such that the on-load current briefly changes over to a load relief circuit which is arranged between a root connection of this first change-over switch and the common output line. Furthermore, a respective one of the two contacts of the first change-over switch is applied to the connection of one selector contact with on permanent contact.

The uninterrupted on-load change-over switching under voltage in tapped transformers is usually carried out by means of mechanical switching elements. The regulating winding to be switched possesses taps connected to a selector which selectively applies the taps to the common output line by means of the on-load change-over switch.

The switch-over is always effected between neighboring taps, i.e. by one step each time. For this purpose, at first the desired tap is preselected by means of the selector. The on-load change-over switch thereupon carries out, under temporary interconnection of transition resistors, the switch-over of the current from the selected tap to the preselected tap. In both end positions the transition resistors are not loaded because they are shunted by the main contacts of the on-load change-over switch.

The selector and the on-load change-over switch are usually accommodated in the transformer tank, whereby the on-load change-over switch is located in a vat of its own, the oil filling of the latter being separated by seals from the oil charge of the transformer.

The burning of contacts occurring during switch-over and the sooting of oil due to electric arcs occurring during switching are thereby disadvantageous. Therefore, in order to ensure trouble-free operation the contacts and the oil have to be changed after a certain number of switching operations, so that there occur interruptions in the operation due to the thus caused transformer shutdown.

Furthermore, constructions are known in which on-load change-over switching is accomplished by means of a combination of mechanical switching elements and thyristors. Such a combination is apparent from British Patent No. 1,399,528.

The arrangement as described in British Patent No. 1,399,528, consists of at least two selector contacts and two permanent contacts, a transition resistor as well as a load relief circuit comprising two thyristors connected in antiparallel, two ignition diodes and a thyristor control contact.

The selector consists of two not simultaneously moved single-pole change-over switches, whereby the change-over contacts of one change-over switch are connected with the change-over contacts of the other change-over switch and are applied to the respective taps of a regulating stage of a regulating winding.

From the root connections of the two selectors, one conductive connection leads directly and the other conductive connection leads via the transition resistor to respective root connections of the two permanent contacts.

Via the selector contacts and the permanent contacts there is effected a connection to a common output line either directly or via the thyristor circuit, depending on the switching position.

In the central position the permanent contacts short-circuit the thyristor circuit. The permanent contacts as well as the thyristor control contact are rigidly connected to a drive shaft.

During the switching-on process, first the thyristor group takes over the on-load current. The thyristor group is then disconnected, thus forcing the on-load current onto the current path of the transition resistor. The preselection of the next regulating stage is effected in that one of the two selector contacts is moved to the desired tap. The thyristor circuit now switches the on-load current to the preselected tap. The second selector contact conducts the compensating current while the on-load current flows via one selector contact.

Several disadvantages arise from this arrangement. During the switch-over process, the thyristor group is loaded with the sum of on-load current and compensating current. In the end position, both selectors lie at one tap; therefore, given the same number of contacts, only half the number of taps can be accommodated at the circumference of the selector. Furthermore, the selector contacts are integrated into the switch-over process in such a manner that there results, from the slow motion thereof, an increase in the time-wise load on the thyristors by at least one order of magnitude.

Another arrangement for on-load change-over switching by means of mechanical switching elements and thyristors is shown by German Patent No. 2,104,076.

In this case as well, the on-load current is conducted to a common output line via winding taps of the regulating stage of a regulating winding and via selector contacts and permanent contacts. Instead of the usual two transition resistors, there are here arranged respective thyristor circuits with thyristors connected in antiparallel. The two thyristor circuits are connected to the common output line by means of respective break contacts.

The switching sequence is controlled by a logic circuit. The sequence is effected such that the on-load current is always switched by the thyristors and, depending upon the switching operation to be carried out in each case, is either subsequently commutated to the permanent contact or has been previously commutated from the permanent contact to the thyristors.

A disadvantage therein is the high constructional expenditure for the electronic components required for the control, and the liability to breakdown of such components.

A further disadvantage is the effect of high voltage on the electronic unit. Moreover, there is a danger that the magnetic fields of the transformer windings trigger misfirings of the thyristors.

In British Patent No. 1,007,496 there is described a further arrangement for on-load change-over switching. In this arrangement there is provided a fixed conductive connection from each tap of the transformer regulating winding to a respective pair of thyristors connected in antiparallel, the outputs of the latter being connected to the common output line.

The thyristors are switched by means of a current control circuit of the transformer. The switch-over from one stage to another is effected in that the selected pair of thyristors is set from the conductive into the non-conductive switching condition, and the preselected pair of thyristors is set from the non-conductive into the conductive switching condition.

Disadvantageous in this arrangement are the high technical expenditure and the liability to breakdown of the electronic components required for the control.

In German Published Patent No. 2,327,610 there is described a construction comprising two load branches which respectively connect a tap of the regulating winding to a common output line. In each load branch there are connected in series a selector contact and a break contact as well as a parallel circuit, the latter comprising a thyristor and a permanent contact. The thyristors are oppositely poled.

Between the two load branches there is arranged a current branch which, by means of a change-over switch, can be connected in parallel to a respective one of the two load branches. This current branch comprises two diodes connected in antiparallel, the input of a voltage detection and ignition device being arranged parallel to the diodes.

In this construction the break contact and the permanent contact associated with the first tap and the first load branch are closed at the start of the switch-over from a first tap to a second tap. The additional current branch is connected in parallel to this load branch by means of the synchronous change-over switch.

By breaking the permanent contact in the first load branch, the on-load current is commutated to the additional current branch. After closing the break contact in the second load branch, the first thyristor is triggered and, simultaneously, the change-over pulse for the synchronous change-over switch is transmitted. The synchronous change-over switch lifts off from the first change-over contact and the current commutates to the first thyristor. By blocking the first thyristor and triggering the second thyristor in the second load branch, the current changes over from the first tap to the second tap and thus via the second selector contact to the second thyristor.

In the meantime, the synchronous change-over switch has arrived at the second change-over contact and the on-load current is taken over by the additional current branch. By breaking the break contact in the first load branch and closing the permanent contact in the second load branch, the change-over operation is terminated.

This construction has the disadvantage that the switch-over cannot be ensured for all operational events and switching moments of time because the switch-over is intended to be effected at the current-zero crossing which can be measured only by means of complicated and trouble-prone electronic devices.

An on-load change-over is also described in U.S. Pat. No. 3,662,253, granted May 9, 1972. Therein two vacuum switches are arranged between a common output line and two selector contacts. Furthermore, there is provided a load relief circuit which is arranged intermediate the common output line and, by means of a change-over switch, a respective selector contact. The load relief circuit is constructed in a manner such that the load relief circuit can be switched into parallel connection with a respective one of the two vacuum switches.

The load relief circuit contains a series connection of a current limiting resistor and a semiconductor switch. A by-pass circuit of large impedance is provided for this semiconductor switch in order to limit occurring current risers. The circuit of the by-pass circuit is coupled to the primary winding of a current transformer having a secondary winding which is connected to a grid control device. The grid control device contains control members which utilize the secondary current rise of the current transformer connected in circuit with the by-pass circuit.

The switch-over between the taps under load is effected during the mutually interdependent switch-on and switch-off adjustments or movements of the vacuum switches and with the interconnection of the load relief circuit.

In this U.S. Pat. No. 3,662,253, there is also suggested a more expensive system for a switch-over between the taps of regulating transformers. In this system again two vacuum switches are arranged between the common output line and the selector contacts. Also, there is arranged in such system a load relief circuit between the common output line and a change-over switch in a manner such that the load relief circuit can be connected parallel to a respective one of the two vacuum switches.

The load relief circuit comprises a series connection of a semiconductor switch and an ohmic resistance. This series connection is connected in parallel with a semiconductor switch. In order to prevent a voltage rise during the switching operations, a voltage limiting circuit is provided and connected parallel to the semiconductor switch of the series connection.

The connecting lines or conductors between the two vacuum switches and the common output line as well as the connecting line or conductor between the voltage limiting circuit and the common output line are each coupled to the primary winding of an associated one of three current transformers. The secondary windings of these current transformers are connected to associated ones of three grid control devices which are responsible for triggering in due time the semiconductor witches of the load relief circuit. Through a corresponding trigger adjustment it is achieved that, during opening and closing of the vacuum switches, the on-load current flows through the semiconductor switches so that there is prevented the formation or occurrence of an arc.

It is a disadvantage in the circuit arrangements as proposed in U.S. Pat. No. 3,662,253 that such circuit arrangements require a complex technical structure which is prone to malfunction or failure.

SUMMARY OF THE INVENTION

Therefore, with the foregoing in mind it is a primary object of the present invention to provide a new and improved arrangement in an on-load change-over switch of an on-load tap changer for uninterrupted switch-over of the regulating winding of a transformer and which arrangement is not afflicted with the drawbacks and limitations of the prior art constructions heretofore discussed.

Another significant object of the present invention is directed to providing a new and improved arrangement in an on-load change-over switch of an on-load tap changer for uninterrupted switch-over of the regulating winding of a transformer and which arrangement maintains at a minimum the voltage and current load on the thyristors during the switching operation.

Now in order to implement these an still further objects of the invention, which will become more readily apparent as the description proceeds, the arrangement of the present development is manifested, among other things, by the features that the on-load current can be conducted via a lower or higher winding tap of a regulating stage of a regulating winding and through a connection of at least two selector contacts and two permanent contacts having a common output line, and that the switch-over from the lower to the higher winding tap, and vice versa, is effected by means of a change-over switch, whereby the on-load current briefly changes over to a load relief circuit which is arranged between the root connection of the change-over switch and the common output line, and that a respective one of the two contacts of the change-over switch is applied to the connection of one selector contact with one permanent contact.

By virtue of the arrangement of the change-over switch in series with the load relief circuit, there is maintained relatively low the expenditure of the component parts required for achieving an arc-free switch-over from one regulating stage to another.

According to one exemplary embodiment of the invention, the load relief circuit comprises two thyristor circuits connected in parallel, the thyristors of each thyristor circuit being connected in antiparallel, whereby one of these thyristor circuits is connected in series with a transition resistor. In this manner, the thyristors for the on-load change-over switching only have to be selected with the view of the step voltage to be switched. Since the thyristors are at star point potential, only two triggering devices are required. One triggering device supplies the respective thyristor circuits without a transition resistor, and the other triggering device supplies the thyristor circuits with a transition resistor at all phases of the transformer. In addition thereto and during continuous operation, the thyristors are not loaded by overvoltage, so that the therefore required protective wiring can be dispensed with. Naturally, there is likewise prevented arc formation and thus a contact burning at the permanent contacts.

In the end positions no load on the thyristors is effected, since the latter are shunted by the respective permanent contact arranged in parallel. A load on the thyristors by short-circuit currents is likewise avoided.

On the basis of a change-over switching time of 120 ms, there can be used the mechanical switching elements employed in the known on-load change-over switches as well as the transition resistors.

A preferred development of the inventive arrangement consists in that the load relief circuit comprises a second change-over switch and a thyristor circuit connected in series to the latter and provided with thyristors connected in antiparallel. A transition resistor is connected with the common output line via a bridging-over switch. One switch-over contact of the second change-over switch is directly connected with the root connection of the first change-over switch, while the other switch-over contact of the second change-over switch is connected via the transition resistor with the root connection of the first change-over switch. Due to such arrangement, there is achieved the important advantage of maintaining relatively small the component expenditure required for accomplishing an arc-free switching operation from one regulating stage to the other. Of course, there is likewise prevented contact burning at the permanent contacts. In the end positions, the thyristors are not loaded because the thyristors are by-passed by the respective parallel arranged permanent contact. There is also avoided loading of the thyristors by short-circuit currents. Moreover, there is required only one triggering device which is actuated twice during the course of one switch-over process.

According to a further development of the invention, the permanent contacts are constructed as a further switch-over contact. In this manner, switching contacts are economized and, additionally there is achieved in a simple manner the construction as a load selector.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
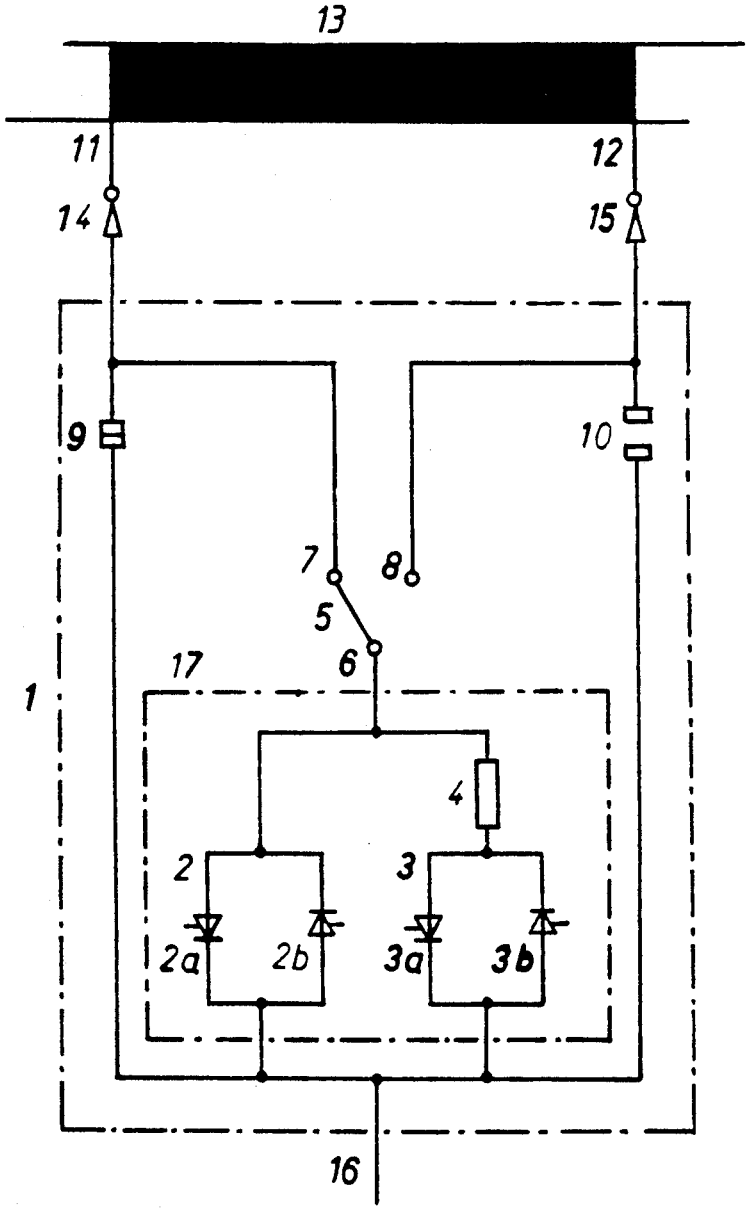
FIG. 1 is a circuit diagram of a first exemplary embodiment of the inventive arrangement.

Describing now the drawings, it is to be understood that only enough of the construction of the arrangement has been shown as needed for those skilled in the art to rapidly understand the underlying principles and concepts of the present development, while simplifying the showing of the drawings. Drawing attention now specifically to FIGS. 1 and 2 of the drawings, there has been shown therein by way of example and not limitation a regulating stage 13 of a regulating winding. The on-load current of the latter can be supplied to a common output line 16 via a lower winding tap 11 or a higher winding tap 12 and through at least two selector contacts 14, 15 and two permanent contacts 9, 10. The switch-over from the lower winding tap to the higher winding tap, and vice versa, is effected by means of a change-over switch 5, whereby the on-load current briefly changes over to a load relieve circuit 17 which is arranged between the root connection 6 of the change-over switch 5 and the common output line 16. A respective one of the two contacts 7 and 8 of the change-over switch 5 is applied to the connection of the selector contacts 14 and 15 with the permanent contacts 9 and 10.

In FIG. 1 the load relief circuit 17 consists of two thyristor circuits 2 and 3 connected in parallel, the thyristors *2a, 2b* and *3a, 3b* thereof being connected in antiparallel, whereby the thyristor circuit 3 is connected in series with a transition resistor 4.

Figure 2:
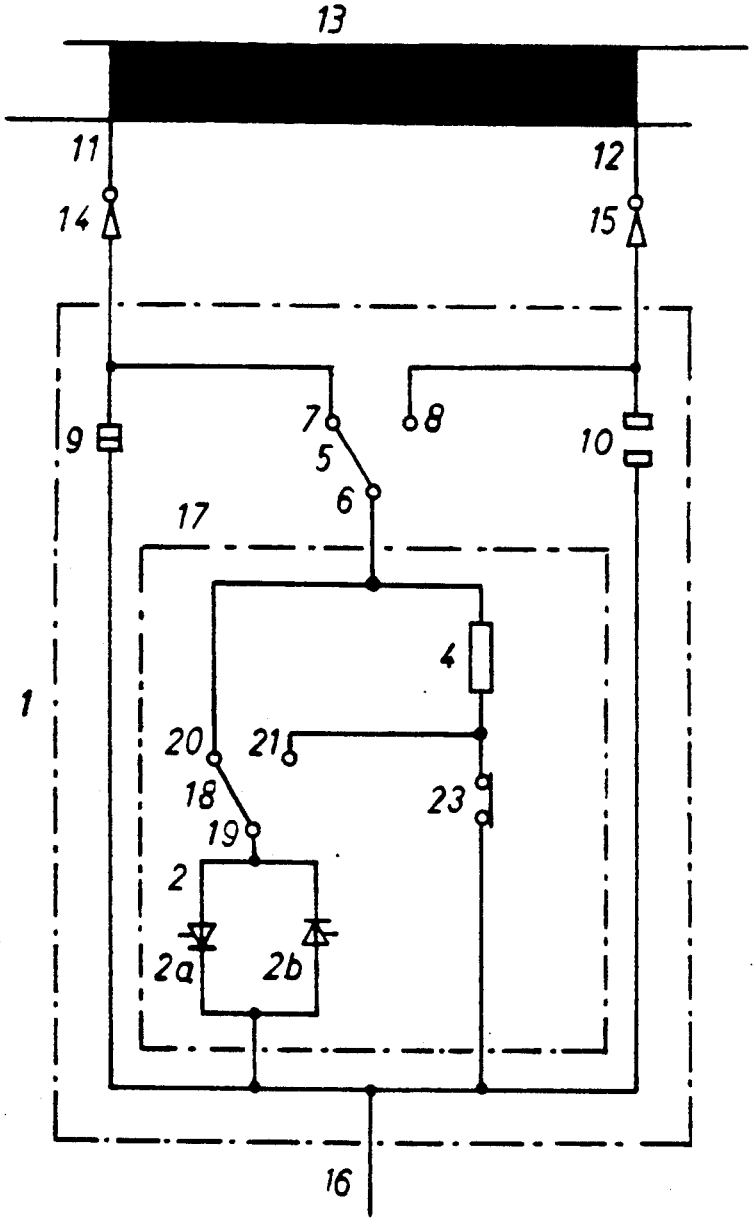
FIG. 2 is a circuit diagram of a second exemplary embodiment of the inventive arrangement.

In FIG. 2 the load relief circuit 17 consists of a change-over switch 18 and a thyristor circuit 2 connected in series to the latter and provided with thyristors *2a, 2b* connected in antiparallel. A transition resistor 4 is connected with the common output line 16 via a bridging-over switch 23. The one switch-over contact 20 of the change-over switch 18 is directly connected with the root connection 6 of the change-over switch 5, while the other switch-over contact 21 is connected via the transition resistor 4 with the root connection 6 of the change-over switch 5.

Figure 3:
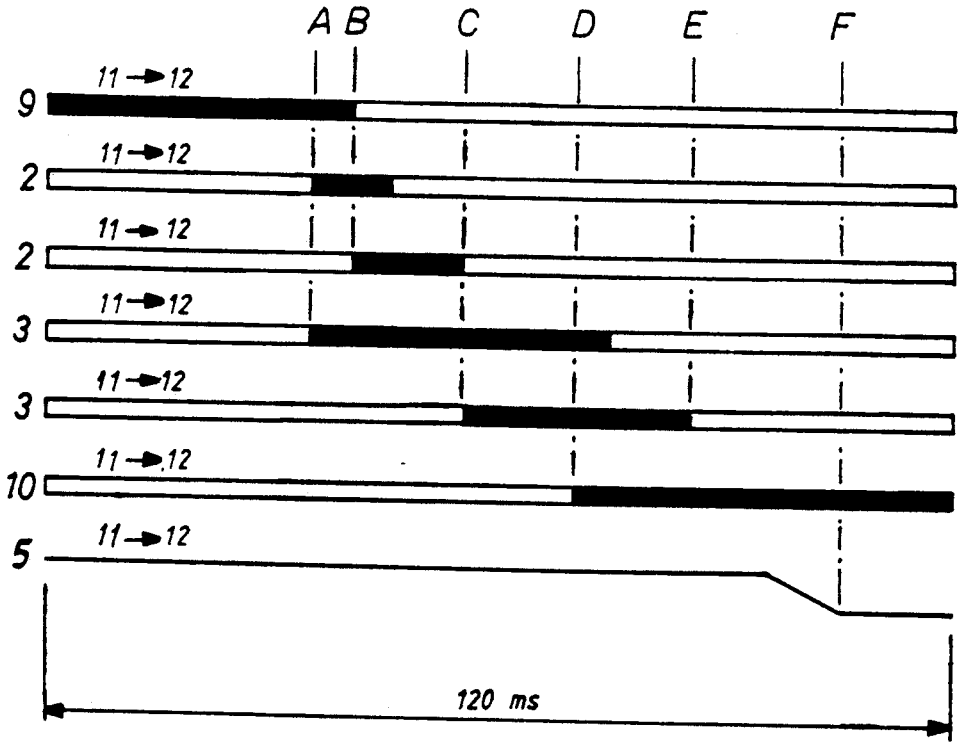
FIG. 3 is a schematic diagram illustrating the time sequence of steps occurring during operation of the first exemplary embodiment of the inventive arrangement as shown in FIG. 1.
Figure 4:
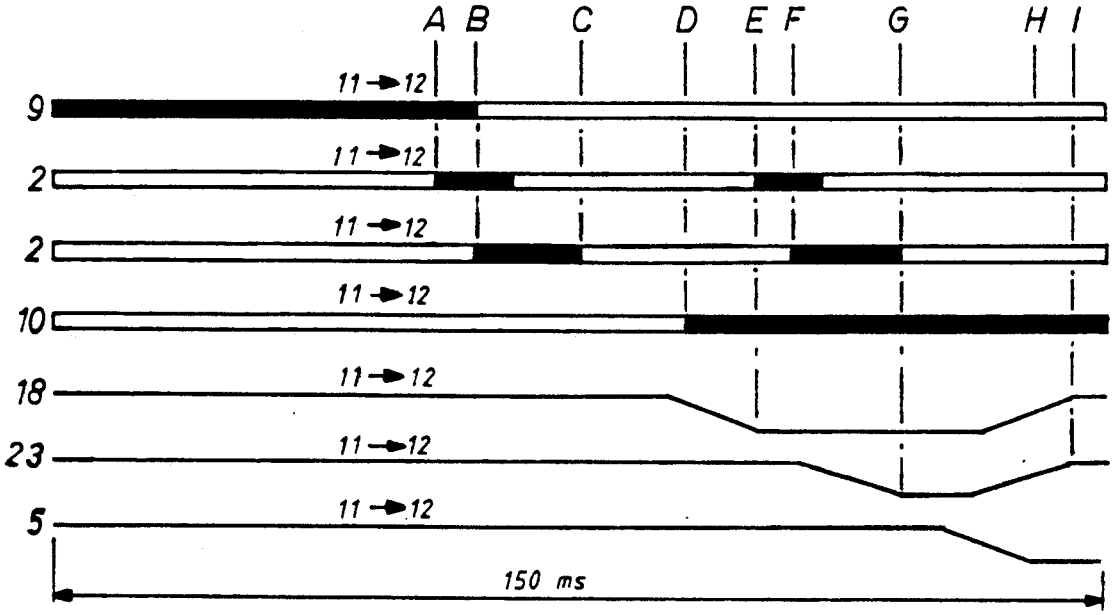
FIG. 4 is a schematic diagram showing the time sequence of steps occurring during operation of the second exemplary embodiment of the inventive arrangement as shown in FIG. 2.
Figure 5:
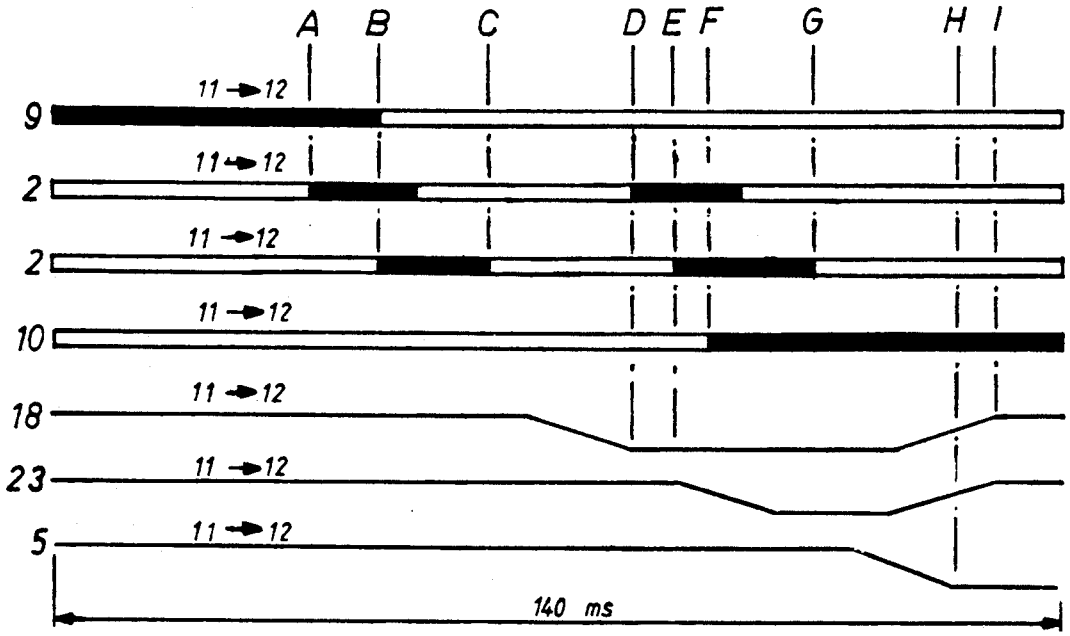
FIG. 5 is a schematic diagram illustrating the time sequence of steps occurring during a modified operation of the second exemplary embodiment of the inventive arrangement as shown in FIG. 2.

As can be seen in the sequence diagrams depicted in FIGS. 3, 4 and 5, the switching times for triggering the thyristors *2a, 2b, 3a, 3b* are asymmetrically offset.

This asymmetry in both switching directions, as well as the end-contact change-over of the change-over switch 5 is to be mechanically accomplished.

With reference to FIGS. 1 and 3 there will be described in the following and in steps a switch-over from the step tap 11 winding. The left-side reference characters in FIG. 3 correspond to the switches, thyristors and contacts depicted in FIG. 1. Furthermore, the reference character 11 12 denotes the switching direction from tap 11 to tap 12. Of the two fields relating to respective ones of the thyristors 2 and 3, the respective first field illustrates the duration of the triggering pulses and the respective second field the duration of the current flow through the thyristors.

| Step | |
|---|---|
| A | Selector contacts 14, 15 and permanent contact 9 are closed, permanent contact 10 is open; change-over switch 5 connects contact 7 via root connection 6 with load relief circuit 17 which is in the non-conducting switching condition; on-load current flows via the winding tap 11 of the regulating stage 13 of the regulating winding as well as through selector contact 14 and permanent contact 9 to the common output line 16. The thyristor circuits 2 and 3 are triggered. |
| B | Permanent contact 9 opens, thyristor circuit 2 takes over on-load current. |
| C | Thyristor circuit 2 is no longer triggered and conducts current only up to the next zero-crossing; thereafter thyristor circuit 3 takes over the on-load current. |
| D | Permanent contact 10 closes, the on-load current now flows via winding tap 12, via selector contact 15 and permanent contact 10 to the common output line 16; thyristor circuit 3 conducts the compensating current. |
| E | Thyristor circuit 3 is no longer triggered and conducts compensating current only up to the next zero-crossing. |
| F | Change-over switch 5 switches root connection 6 from contact 7 to contact 8; thyristor circuit 2 as well as thyristor circuit 3 with transition resistor 4 are connected in parallel to permanent contact 10 and thus ready for the next step switch-over. |

For the load relief circuit according to FIG. 1, the following relationships are applicable.

On load current duration of the thyristor circuit 2: $t_L$ . . . 15–20 ms

Voltage load of the thyristor circuit 2: $U_{TH}=I_L \times R_U$

Current load of the thyristor circuit 2 due to the compensating current $$I_A = \frac{E_{ST}}{R_U}$$

Compensating current duration: $t_A$ . . . 5–15 ms

Voltage load of the thyristor circuit 3: solely $E_{ST}$

The above abbreviations are defined as follows:

$I_L$ . . . on-load current $I_A$ . . . compensating current $U_{TH}$ . . . voltage at thyristor $E_{ST}$ . . . step voltage $R_U$ . . . transition resistance $t_L$ . . . on-load current duration $t_A$ . . . compensating current duration In the following, there will be described with reference to FIGS. 2 and 4 a switch-over from the step tap 11 to the step tap 12 of the regulating state 13 of the regulating winding, whereby the load relief circuit comprises a change-over switch and a bridging-over switch, a thyristor circuit and a transition resistor. The left-side reference characters in FIG. 4 correspond to the switches, thyristors and contacts in FIG. 2. Furthermore the reference character 11 12 denotes the switching direction from tap 11 to tap 12. Of the two fields relating to the thyristor 2, the first field illustrates the duration of the triggering pulses and the second field the duration of the current flow through the thyristors.

| Step | |
|---|---|
| A | Selector contacts 14, 15 and permanent contact 9 are closed; change-over switch 5 connects contact 7 via root connection 6 with load relief circuit 17 which is in the non-conducting switching condition; change-over switch 18 connects contact 20 with root connection 19; thyristor circuit 2 is in the non-conducting switching condition; bridging-over switch 23 is closed; on-load current flows via winding tap 11 of the regulating stage 13 of the regulating winding as well as through selector contact 14 and permanent contact 9 to the common output line 16. The thyristor circuit 2 is triggered. |
| B | Permanent contact 9 opens, thyristor circuit 2 takes over on-load current. |
| C | Thyristor circuit 2 is no longer triggered and conducts current only up to the next zero-crossing; thereafter on-load current flows through transition resistor 4 and bridging-over switch 23. |
| D | Change-over switch 18 opens, permanent contact 10 closes; on-load current, reduced by the compensating current, flows via winding tap 12, selector contact 15 and permanent contact 10 to the common output line 16; compensating current flows through transition resistor 4 and bridging-over switch 23. |
| E | Change-over switch 18 connects root connection 19 with contact 21; thyristor circuit 2 is triggered. |
| F | Bridging-over switch 23 opens; compensating current flows through thyristor circuit 2. |
| G | Thyristor circuit 2 is no longer triggered and conducts the compensating current only up to the next zero-crossing; thereafter on-load current flows via winding tap 12, selector contact 15 and permanent contact 10 to the common branch lead 16. |
| H | Change-over switch 5 switches root connection 6 from contact 7 to contact 8. |
| I | Change-over switch 18 switches from contact 21 to contact 20; bridging-over switch 23 closes, so that the load relief circuit is ready for the next step |

-continued

| Step | |
|---|---|
| | switch-over. |

With reference to FIGS. 2 and 5 there will be described another variant of the switch-over from the step tap 11 to the step tap 12 of the regulating stage 13 of the regulating winding.

The steps A through C are equivalent with the preceding description of the switch-over process. The further steps are hereinafter listed.

| | |
|---|---|
| D | Change-over switch 18 switches root connection 19 from contact 20 to contact 21. Thyristor circuit 2 is triggered. |
| E | Bridging-over switch 23 opens; thyristor circuit 2 takes over the on-load current. |
| F | Permanent contact 10 closes; on-load current, reduced by the compensating current, flows via step tap 12, selector contact 15 and permanent contact 10 to the common output line 16; thyristor circuit 2 conducts the compensating current. |
| G | Thyristor circuit 2 is no longer triggered and conducts the compensating current only up to the next zero-crossing. |
| H | Change-over switch 5 switches root connection 6 from contact 7 to contact 8. |
| I | Change-over switch 18 switches from contact 21 to contact 20; bridging-over switch 23 closes; thus the load relief circuit is ready for the next step switch-over. |

While there are shown and described present preferred embodiments of the invention, it is to be distinctly understood that the invention is not limited thereto, but may be otherwise variously embodied and practiced within the scope of the following claims.

Accordingly, what I claim is:

1. An arrangement in an on-load change-over switch of an on-load tap changer for uninterrupting switch-over of the regulating winding of a transformer, comprising:

a regulating stage of the regulating winding;

said regulating stage containing a higher winding tap and a lower winding tap;

at least two selector contacts;

at least two permanent contacts;

conductors respectively connecting said at least two selector contacts and said at least two permanent contacts;

a common output line;

said higher winding tap and said lower winding tap being respectively connected to said common output line through respective ones of said at least two selector contacts and said at least two permanent contacts for conducting load current from a respective one of said higher winding tap and said lower winding tap to said common output line;

a first change-over switch;

said first change-over switch having a root connection and two switching contacts respectively connected to said higher winding tap and said lower winding tap;

said two switching contacts of said first change-over switch being respectively connected to said conductors respectively connecting said at least two selector contacts and said at least two permanent contacts;

a load relief circuit interconnecting said root connection of said first change-over switch and said common output line;

said first change-over switch switching between said higher winding tap and said lower winding tap such that said load current is briefly passed to said load relief circuit;

said load relief circuit containing a second change-over switch and a thyristor circuit;

said thyristor circuit being connected in series with said second change-over switch and containing two thyristors in antiparallel connections;

said load relief circuit further containing a series connection of a transition resistor and a bridging-over switch;

said series connection of said transition resistor and said bridging-over switch being connected to said common output line;

said second change-over switch containing two switching contacts;

one of said two switching contacts of said second change-over switch being directly connected to said root connection of said first change-over switch; and an other one of said two switching contacts of said second change-over switch being connected to said root connection of said first change-over switch through said transition resistor.

2. The arrangement as defined in claim 1, wherein:

said at least two permanent contacts are constructed as a further switching contact.

* * * * *